US007290606B2

(12) United States Patent
Coronado et al.

(10) Patent No.: US 7,290,606 B2
(45) Date of Patent: Nov. 6, 2007

(54) INFLOW CONTROL DEVICE WITH PASSIVE SHUT-OFF FEATURE

(75) Inventors: Martin Coronado, Cypress, TX (US); Steve Crow, Kingwood, TX (US); Knut H. Henriksen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/219,511

(22) Filed: Sep. 2, 2005

(65) Prior Publication Data

US 2006/0076150 A1 Apr. 13, 2006

Related U.S. Application Data

(63) Continuation-in-part of application No. 11/193,182, filed on Jul. 29, 2005.

(60) Provisional application No. 60/592,496, filed on Jul. 30, 2004.

(51) Int. Cl.
*E21B 43/12* (2006.01)
*E21B 43/14* (2006.01)
*E21B 34/08* (2006.01)

(52) U.S. Cl. ..... 166/250.15; 166/54; 166/105.5; 166/313

(58) Field of Classification Search ..... 166/313, 166/54, 105.5, 250.15
See application file for complete search history.

(56) References Cited

U.S. PATENT DOCUMENTS 1,362,552 A 12/1920 Alexander et al.

(Continued)

FOREIGN PATENT DOCUMENTS

CN 1385594 12/2002

(Continued)

OTHER PUBLICATIONS

Optimization of Commingled Production Using Infinitely Variable Inflow Control Valves; M.M, J. J. NAUS, Delft University of Technology (DUT). Shell International Exploration and production (SIEP); J.D. Jansen, DUT and SIEP; SPE Annual Technical Conference and Exhibition, 26-29 Sep. Houston, Texas, 2004, Society of Patent Engineers.

(Continued)

*Primary Examiner*—Hoang Dang
(74) *Attorney, Agent, or Firm*—Madan, Mossman & Sriram, P.C.

(57) ABSTRACT

Devices and methods for control flow of formation fluids respect to one or more selected parameter relating to the wellbore fluid. In one embodiment, a flow control device for controlling fluid flow into the production tubular uses a flow restriction member that is actuated by a character change of the formation fluid, such as liquid to gas or oil to water. The flow restriction member can be sensitive to a change in density of the formation fluid. The flow restriction member is passive, self-regulating and does not need any power source or control signal to control fluid flow. In one embodiment, the flow control device automatically rotates into a predetermined orientation upon being positioned in the wellbore. A seal disposed on the flow control devices expands into sealing engagement with an enclosure after the flow control device assumed the desired predetermined position.

28 Claims, 9 Drawing Sheets

U.S. PATENT DOCUMENTS

| | | | | |
|---|---|---|---|---|
| 1,649,524 | A | | 11/1927 | Hammond |
| 1,984,741 | A | * | 12/1934 | Harrington ..... 251/210 |
| 2,089,477 | A | | 8/1937 | Halbert |
| 2,214,064 | A | | 9/1940 | Niles |
| 2,257,523 | A | | 9/1941 | Combs |
| 2,412,841 | A | | 12/1946 | Spangler |
| 2,762,437 | A | | 9/1956 | Egan et al. |
| 2,810,352 | A | * | 10/1957 | Tumilson ..... 166/54 |
| 3,385,367 | A | * | 5/1968 | Kollsman ..... 166/191 |
| 3,451,477 | A | * | 6/1969 | Kelley ..... 166/265 |
| 3,675,714 | A | | 7/1972 | Thompson |
| 3,739,845 | A | | 6/1973 | Berry et al. |
| 3,791,444 | A | | 2/1974 | Hickey |
| 3,951,338 | A | | 4/1976 | Genna |
| 4,173,255 | A | | 11/1979 | Kramer |
| 4,287,952 | A | | 9/1981 | Erbstoesser |
| 4,491,186 | A | | 1/1985 | Alder |
| 4,497,714 | A | | 2/1985 | Harris |
| 4,974,674 | A | | 12/1990 | Wells |
| 4,998,585 | A | | 3/1991 | Newcomer et al. |
| 5,333,684 | A | * | 8/1994 | Walter et al. ..... 166/54 |
| 5,337,821 | A | | 8/1994 | Peterson |
| 5,435,393 | A | | 7/1995 | Brekke et al. |
| 5,435,395 | A | | 7/1995 | Connell |
| 5,597,042 | A | | 1/1997 | Tubel et al. |
| 5,609,204 | A | | 3/1997 | Rebardi et al. |
| 5,673,751 | A | | 10/1997 | Head et al. |
| 5,803,179 | A | | 9/1998 | Echols et al. |
| 5,831,156 | A | | 11/1998 | Mullins |
| 5,873,410 | A | | 2/1999 | Iato et al. |
| 5,881,809 | A | | 3/1999 | Gillespie et al. |
| 6,068,015 | A | | 5/2000 | Pringle |
| 6,112,815 | A | | 9/2000 | Boe et al. |
| 6,112,817 | A | | 9/2000 | Voll et al. |
| 6,253,861 | B1 | | 7/2001 | Carmichael et al. |
| 6,273,194 | B1 | | 8/2001 | Hiron et al. |
| 6,305,470 | B1 | | 10/2001 | Woie |
| 6,367,547 | B1 | | 4/2002 | Towers et al. |
| 6,371,210 | B1 | | 4/2002 | Bode et al. |
| 6,505,682 | B2 | * | 1/2003 | Brockman ..... 166/250.15 |
| 6,516,888 | B1 | | 2/2003 | Gunnarson et al. |
| 6,622,794 | B2 | | 9/2003 | Zisk, Jr. |
| 6,679,324 | B2 | | 1/2004 | Boer et al. |
| 6,786,285 | B2 | | 9/2004 | Johnson et al. |
| 6,817,416 | B2 | | 11/2004 | Wilson et al. |
| 7,185,706 | B2 | | 3/2007 | Freyer |
| 2002/0125009 | A1 | | 9/2002 | Wetzel et al. |
| 2004/0144544 | A1 | | 7/2004 | Freyer |
| 2005/0016732 | A1 | | 1/2005 | Brannon et al. |
| 2005/0189119 | A1 | | 9/2005 | Gynz-Rekowski |

FOREIGN PATENT DOCUMENTS

| | | | |
|---|---|---|---|
| GB | 1492345 | | 11/1977 |
| SU | 1335677 A | * | 9/1987 |
| WO | WO 00/779097 | | 5/2000 |
| WO | WO 01/65063 | | 2/2001 |
| WO | WO 01/77485 | | 3/2001 |
| WO | WO 2006/015277 | | 7/2005 |

OTHER PUBLICATIONS

An Oil Selective Inflow Control System; Rune Freyer, Easy Well Solutions; Morten Fejerskkov, Norsk Hydro; Arve Huse, Altinex: European Petroleum Conference, 29-31 Oct., Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, Mar.; pp. 13-18; 1997 Society of Petroleum Engineers.

* cited by examiner

INFLOW CONTROL DEVICE WITH PASSIVE SHUT-OFF FEATURE

CROSS-REFERENCE TO RELATED APPLICATIONS

This application is a continuation in part of U.S. patent application Ser. No. 11/193,182 filed on Jul. 29, 2005, titled "DOWNHOLE INFLOW CONTROL DEVICE WITH SHUT-OFF FEATURE" which takes priority from U.S. Provisional Application Ser. No. 60/592,496 filed on Jul. 30, 2004.

BACKGROUND OF THE INVENTION

1. Field of the Invention

The invention relates generally to systems and methods for selective control of fluid flow into a production string in a wellbore. In particular aspects, the invention relates to devices and methods for actuating flow control valves in response to increased water or gas content in the production fluids obtained from particular production zones within a wellbore. In other aspects, the invention relates to systems and methods for monitoring flow rate or flow density at completion points and adjusting the flow rate at individual production points in response thereto.

2. Description of the Related Art

During later stages of production of hydrocarbons from a subterranean production zone, water and/or gas often enters the production fluid, making production less profitable as the production fluid becomes increasingly diluted. For this reason, where there are several completion nipples along a wellbore, it is desired to close off or reduce inflow from those nipples that are located in production zones experiencing significant influx of water and/or gas. It is, therefore, desirable to have a means for controlling the inflow of fluid at a particular location along a production string.

A particular problem arises in horizontal wellbore sections that pass through a single layer containing production fluid. If fluid enters the production tubing unevenly, it may draw down the production layer non-uniformly, causing nearby gas to be drawn down, or water drawn up, into the production tubing at an accelerated rate. Inflow control devices are therefore used in association with sand screens to equalize the rate of fluid inflow into the production tubing across the productive interval. Typically a number of such inflow governing devices are placed sequentially along the horizontal portion of the production assembly.

The structure and function of inflow control devices is well known. Such devices are described, for example, in U.S. Pat. Nos. 6,112,817; 6,112,815; 5,803,179; and 5,435,393. Generally, the inflow control device features a dual-walled tubular housing with one or more inflow passages laterally disposed through the inner wall of the housing. A sand screen surrounds a portion of the tubular housing. Production fluid will enter the sand screen and then must negotiate a tortuous pathway (such as a spiral pathway) between the dual walls to reach the inflow passage(s). The tortuous pathway slows the rate of flow and maintains it in an even manner.

Another conventional device is shown in United States Patent Application 2004/0144544, which discloses an arrangement for restricting the inflow of formation water from an underground formation to a hydrocarbon producing well. Between the underground formation and a production tubing located in the well, there is disposed at least one flow chamber connected to the production tubing. The flow chamber is open to inflow of formation fluid and in communication with the production tubing via an opening. The flow chamber is provided with at least one free-floating body with approximately the same density as the formation water. The free-floating body closes the opening (choking or reducing inflow) when formation water enters the flow chamber. It is believed that orientation of the opening with regard to adjacent sand screen orientations could be problematic and that the openings could be susceptible to plugging. Further, the disclosed device is described as adapted for reducing only water flow and thus cannot reduce gas inflow.

Thus, conventional inflow control devices currently lack an acceptable means for selectively closing off flow into the production tubing in the event that water and/or gas invades the production layer. The present invention addresses these and other drawbacks of the prior art.

SUMMARY OF THE INVENTION

In aspects the present invention provides systems, devices and methods for controlling the flow of fluid from a subterranean formation into a production tubular. Flow of these formation fluids can be controlled with respect to one or more selected parameter relating to the wellbore fluid, such as the type of fluid, the phase of fluid, fluid pressure, fluid velocity, water content, etc. In one embodiment, a flow control device for controlling fluid flow into the production tubular uses a flow restriction member that moves between an full flow position (or open position) and a restricted flow position (or closed position) when actuated by a phase change of the formation fluid. For example, the flow restriction member can be sensitive to a change in density of the formation fluid. In one arrangement, the flow restriction member is formed of a material having a density that is lower than a density of a selected liquid and higher than a density of a selected gas. Thus, the flow restriction member floats to an open position to provide a first cross-sectional flow area for liquid and sinks to a closed position to provide a second cross-sectional flow area for gas. The second position may also be configured to close off flow totally. The first cross-sectional flow area is larger than the second cross-sectional flow area, which biases production flow to favor greater liquid (e.g., oil) flow and reduce gas flow. Advantageously, the flow restriction member is passive, which means that it requires no external intervention. That is, the flow restriction member is self-regulating and does not need any power source or control signal to control fluid flow. It will be appreciated, therefore, that embodiments of the present invention can be robust and have service lives that are consistent with the production life of a well.

In one arrangement, a fluid control device includes a body having a passage in communication with a bore of a production tubular. A seal surrounds the body to seal the annular spaces between the body and adjacent structures such as a production tubular and a housing enclosing the body. The flow restriction member in this arrangement is coupled to the body and selectively restricts fluid flow into the passage. The coupling arrangement can be a hinge for rotational motion or a slot or track for translational motion. Additionally, the body can be rotatably coupled to the production tubular to allow the body to rotate to a predetermined orientation upon being positioned in the wellbore. This predetermined orientation can be a wellbore high side, the wellbore low side, or other selected azimuthal position. One manner of automatically orienting the fluid control device includes configuring the body to have a weighed portion or section that drops to the wellbore low side, which then can align or orient the flow restriction device. To facilitate rotation, the seal is configured to engage the housing wall and seal the annular space only after the body has rotated to the appropriate position. For example, the seal can be formed of a material that expands when exposed to wellbore fluid, which allows the seal to be in an un-expanded state while the body is tripped into the well and during the time the body rotates into position. In other embodiments, the seal can be expanded using a pressurized media or other suitable mechanisms. Additionally, the flow control devices can be used in conjunction with a particulate control device that reduces the size of entrained particles in the fluid before the fluid enters the passage of the body and/or an inflow control device that reduces the flow velocity of the fluid entering the production string.

In embodiments, a plurality of flow control devices are distributed along a production tubular to control production flow at spaced apart locations along the production tubular. The flow control devices can be configured such that a desired fluid, such as oil, is mostly produced at all or most locations along the production tubular. As can be appreciated, evenly draining a reservoir can minimize damage to the reservoir and reduce the likelihood of undesirable conditions such as gas or water coning. Moreover, since this control is done passively, this control over production flow extend over the life of a well.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
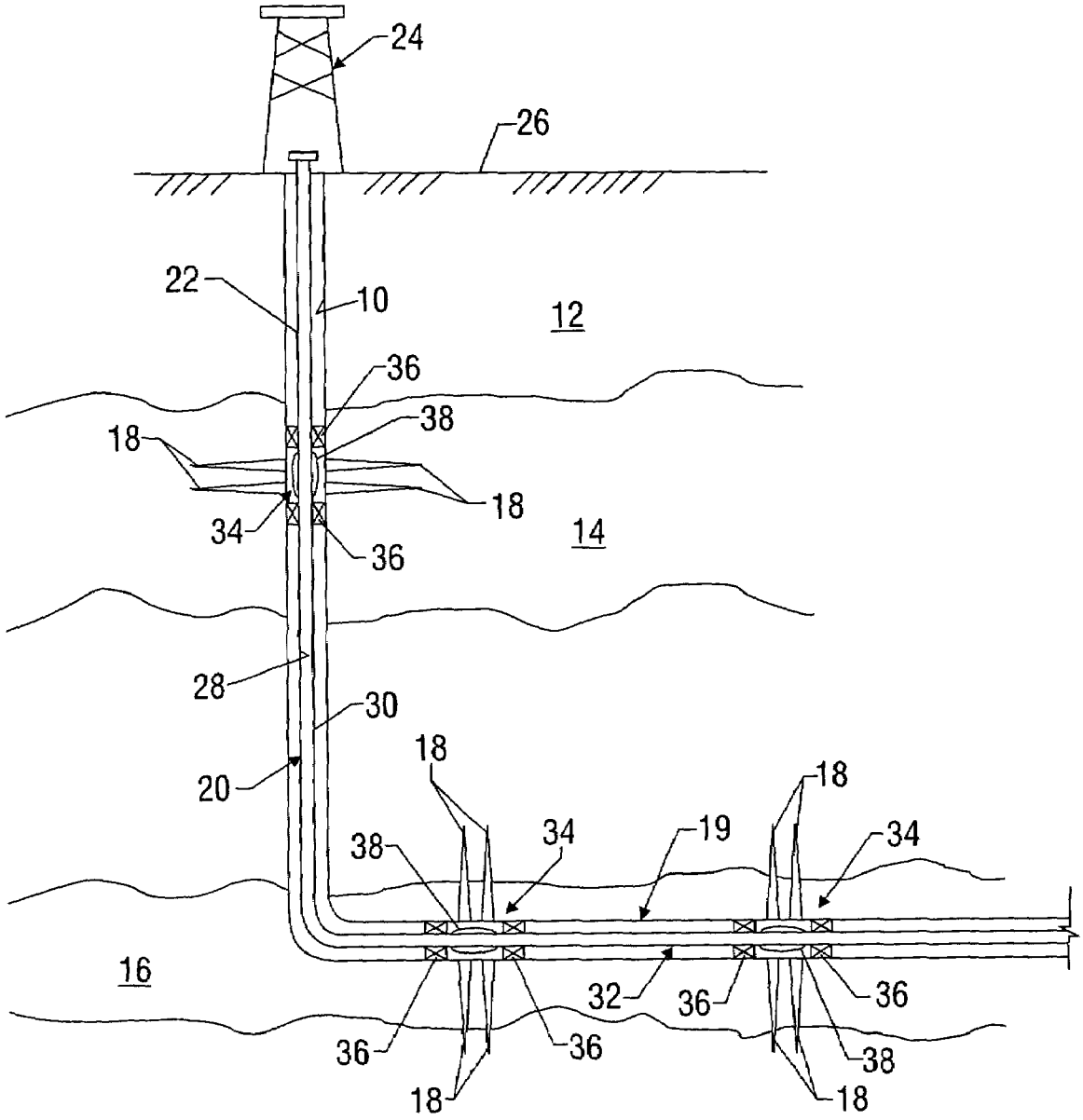
FIG. 1 is a side, cross-sectional view of an exemplary multi-zonal wellbore and production assembly which incorporates an inflow control system in accordance with the present invention.

The present invention relates to devices and methods for controlling production of a hydrocarbon producing well. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14,16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. At selected points along the production assembly 20 are production nipples 34. Optionally, each production nipple 34 is isolated within the wellbore 10 by a pair of packer devices 36. Although only two production nipples 34 are shown in FIG. 2, there may, in fact, be a large number of such nipples arranged in serial fashion along the horizontal portion 32.

Each production nipple 34 features a production control device 38 that is used to govern one or more aspects of the flow into the production assembly 20. In accordance with the present invention, the production control device 38 may have a number of alternative constructions that ensure selective operation and controlled fluid flow therethrough. In certain embodiments, the devices are responsive to control signals transmitted from a surface and/or downhole location. In other embodiments, the devices are adaptive to the wellbore environment. Exemplary adaptive devices can control flow in response to changes in ratios in fluid admixtures, temperatures, density and other such parameters. These and other embodiments are discussed in commonly assigned co-pending U.S. patent application Ser. No. 11/193,182, filed Jul. 30, 2005, which is hereby incorporated by reference for all purposes.

Figure 1A:
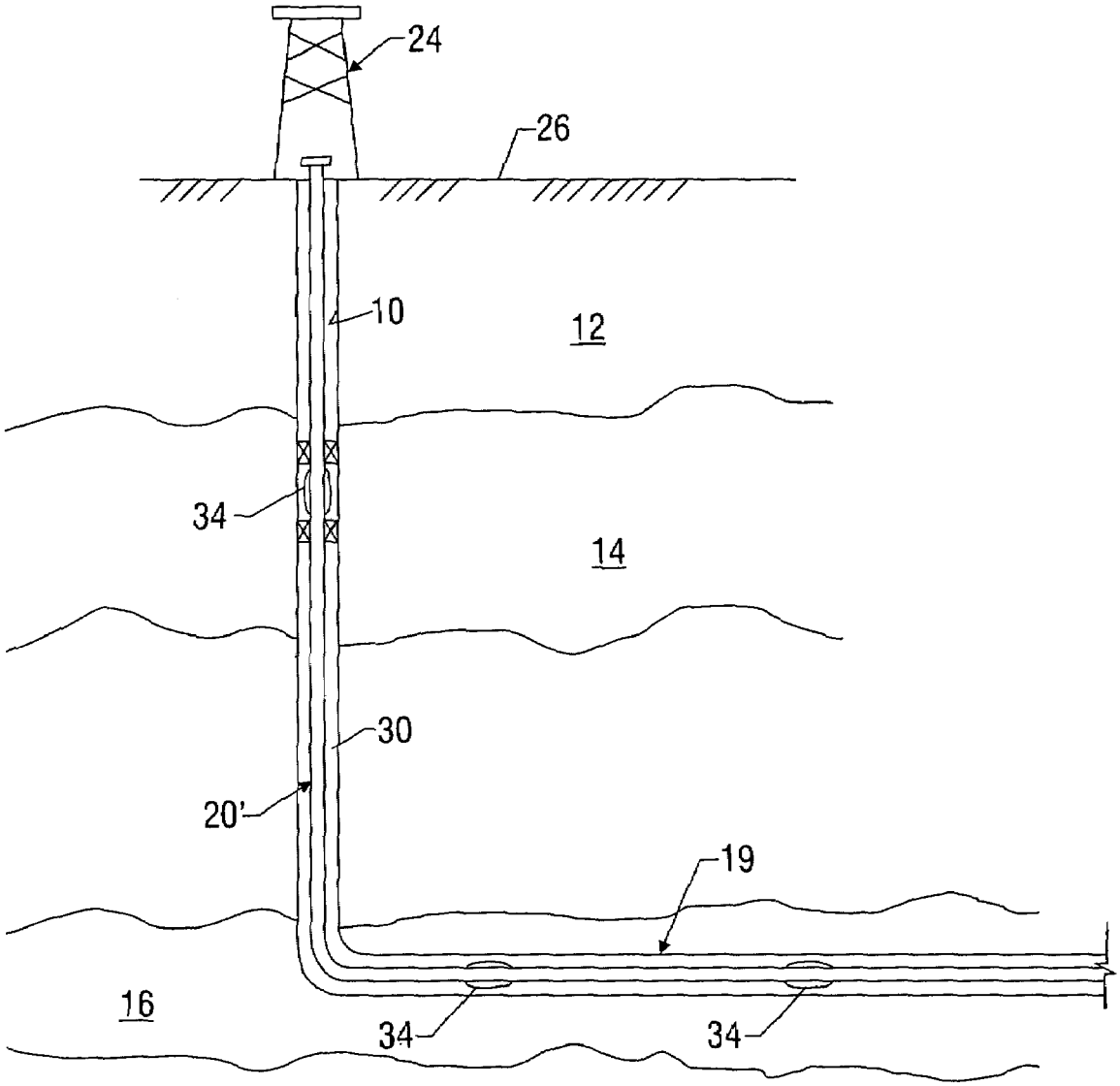
FIG. 1A is a side, cross-sectional view of an exemplary open hole production assembly which incorporates an inflow control system in accordance with the present invention.

FIG. 1A illustrates an exemplary open hole wellbore arrangement 10' wherein the production devices of the present invention may be used. Construction and operation of the open hole wellbore 10' is similar in most respects to the wellbore 10 described previously. However, the wellbore arrangement 10' has an uncased borehole that is directly open to the formations 14, 16. Production fluids, therefore, flow directly from the formations 14, 16, and into the annulus 30 that is defined between the production assembly 20' and the wall of the wellbore 10'. There are no perforations 18, and typically no packers 36 separating the production nipples 34. The nature of the production control device is such that the fluid flow is directed from the formation 16 directly to the nearest production nipple 34, hence resulting in a balanced flow.

Figure 2:
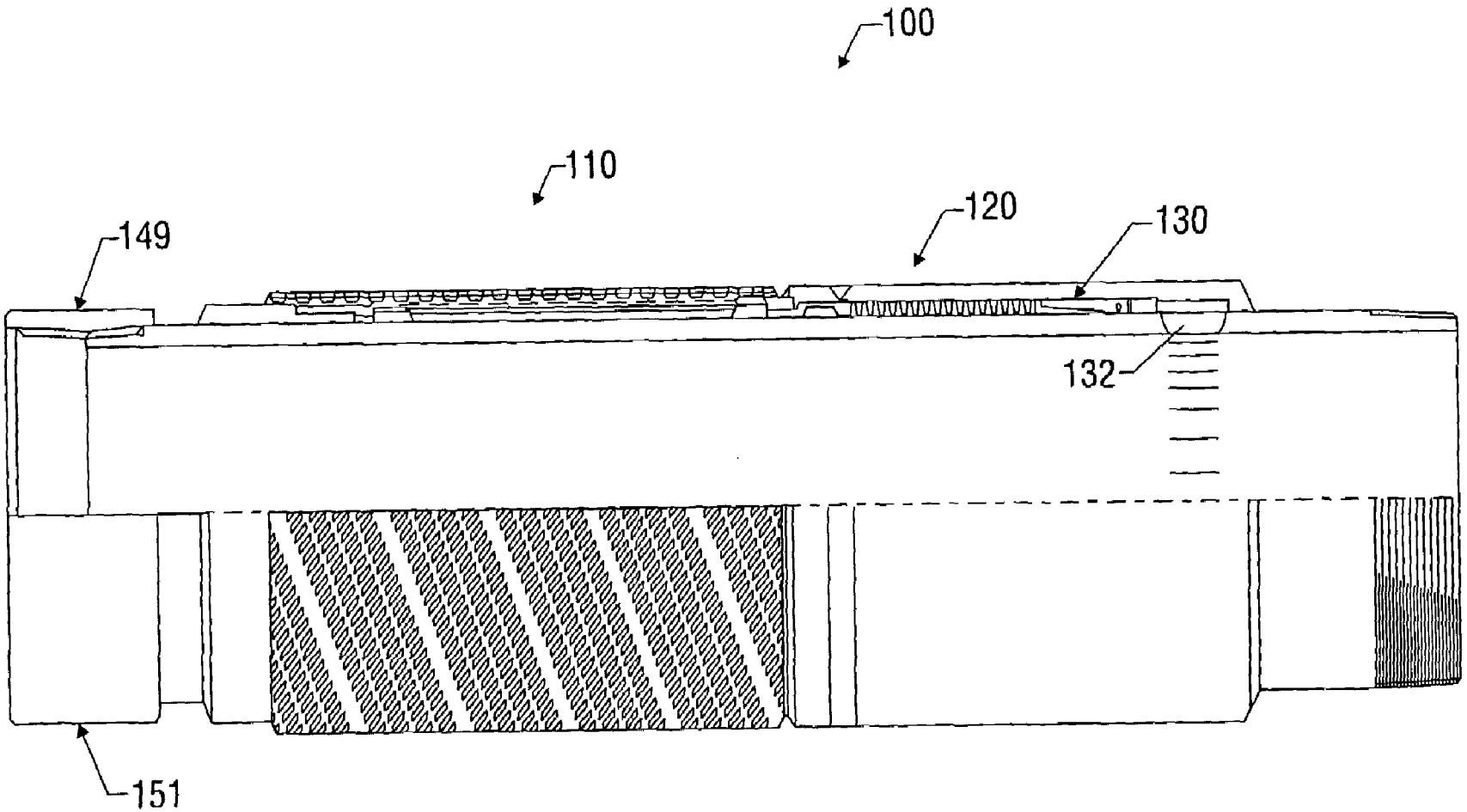
FIG. 2 is a side, cross-sectional view of an exemplary production control device made in accordance with one embodiment of the present invention.

Referring now to FIG. 2, there is shown one embodiment of a production control device 100 for controlling the flow of fluids from a reservoir into a production string. This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed hereinbelow.

In one embodiment, the production control device 100 includes a particulate control device 110 for reducing the amount and size of particulates entrained in the fluids, an in-flow control device 120 that controls overall drainage rate from the formation, and a fluid phase control device 130 that controls in-flow area based upon the phase of the fluid in the production control device. The particulate control device 110 can include known devices such as sand screens and associate gravel packs and the in-flow control device 120 can utilize devices employing tortuous fluid paths designed to control inflow rate by created pressure drops. These devices have been previously discussed and are generally known in the art.

Figure 3A:
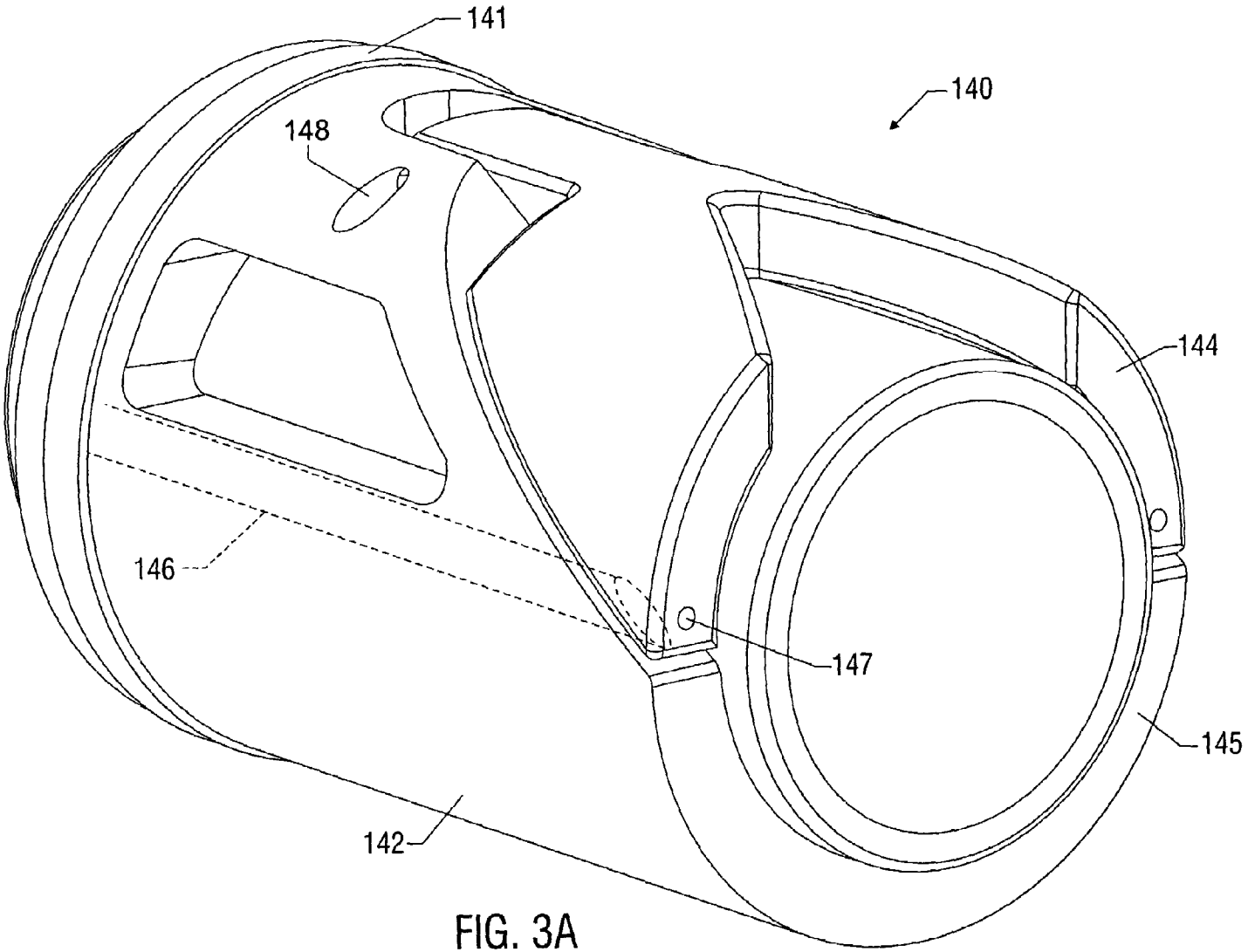
FIG. 3A is an isometric view of a phase control device made in accordance with one embodiment of the present invention.

An exemplary phase control device 130 is adapted to control the in-flow area based upon the phase state (e.g., liquid or gas) of the in-flowing fluid. Moreover, embodiments of the phase control device 130 are passive. By "passive," it is meant that the phase control device 130 controls in-flow area without human intervention, intelligent control, or an external power source. Illustrative human intervention includes the use of a work string to manipulate a sliding sleeve or actuate a valve. Illustrative intelligent control includes a control signal transmitted from a downhole or surface source that operates a device that opens or closes a flow path. Illustrative power sources include downhole batteries and conduits conveying pressurized hydraulic fluid or electrical power lines. Embodiments of the present invention are, therefore, self-contained, self-regulating and can function as intended without external inputs, other than interaction with the production fluid Referring now to FIG. 3A, there is shown one embodiment of a phase control device 140 that controls fluid in-flow based upon the density of the in-flowing fluid. The phase control device 140 includes a seal 141, a body 142 and a flow restriction element 144. The term "flow restriction element," "closure element," "flapper," are used interchangeable to denote a member suited to blocking or obstructing the flow of a fluid in or to a conduit, passage or opening. The seal 141 prevents fluid flow through the annular flow area between the body 142 and an enclosing structure such as a housing (not shown) or even a wellbore tubular such as casing (not shown). Another seal (not shown) seals off the annular passage between the body 142 and the production tubular 145. The body 142 is positioned on a pipe section 145 along a production tubular string (not shown) and includes a passage 146 through which fluid must flow prior to entering the production assembly 20 (FIG. 1). The passage 146, while shown as slotted, can be of any suitable configuration. The flow restriction element 144 is adapted to restrict fluid flow into the passage 146. Restriction should be understood to mean a reduction in flow as well as completely blocking flow. The flow restriction element 144, in one arrangement, is coupled to the body 142 with a suitable hinge 143. Thus, the flow restriction element 144 rotates or swings between an open position wherein fluid can enter the passage 146 and closed position, as depicted in FIG. 3A, wherein fluid is blocked from entering the passage 146. As explained earlier, fluid does not necessarily have to be completely blocked. For example, the flow restriction element 144 can include one or more channels 147 that allow a reduced amount of fluid to enter the passage 146 even when the flow restriction element 144 is in the closed position. The flow restriction element moves between the open and closed positions as the phase of the flowing fluid transitions between a liquid phase and a gas phase or between a water phase and oil phase. In one arrangement, the flow restriction element 144 is positioned on the "high side" 149 (FIG. 2) of the production string and is in an open position when the flowing fluid is a liquid and in a closed position when the flowing fluid is a gas. In this arrangement, the density of the material forming the flow restriction element is selected to be less than a selected liquid such as oil but greater than a gas such as methane. Thus, the flow restriction element 144 "floats" in the liquid and "sinks" in the gas. As can be seen, the sensitivity of the flow restriction element 144 to the density of the flowing fluid allows the flow restriction element 144 to passively control the fluid in-flow as a function of the phase of the fluid.

Figure 3B:
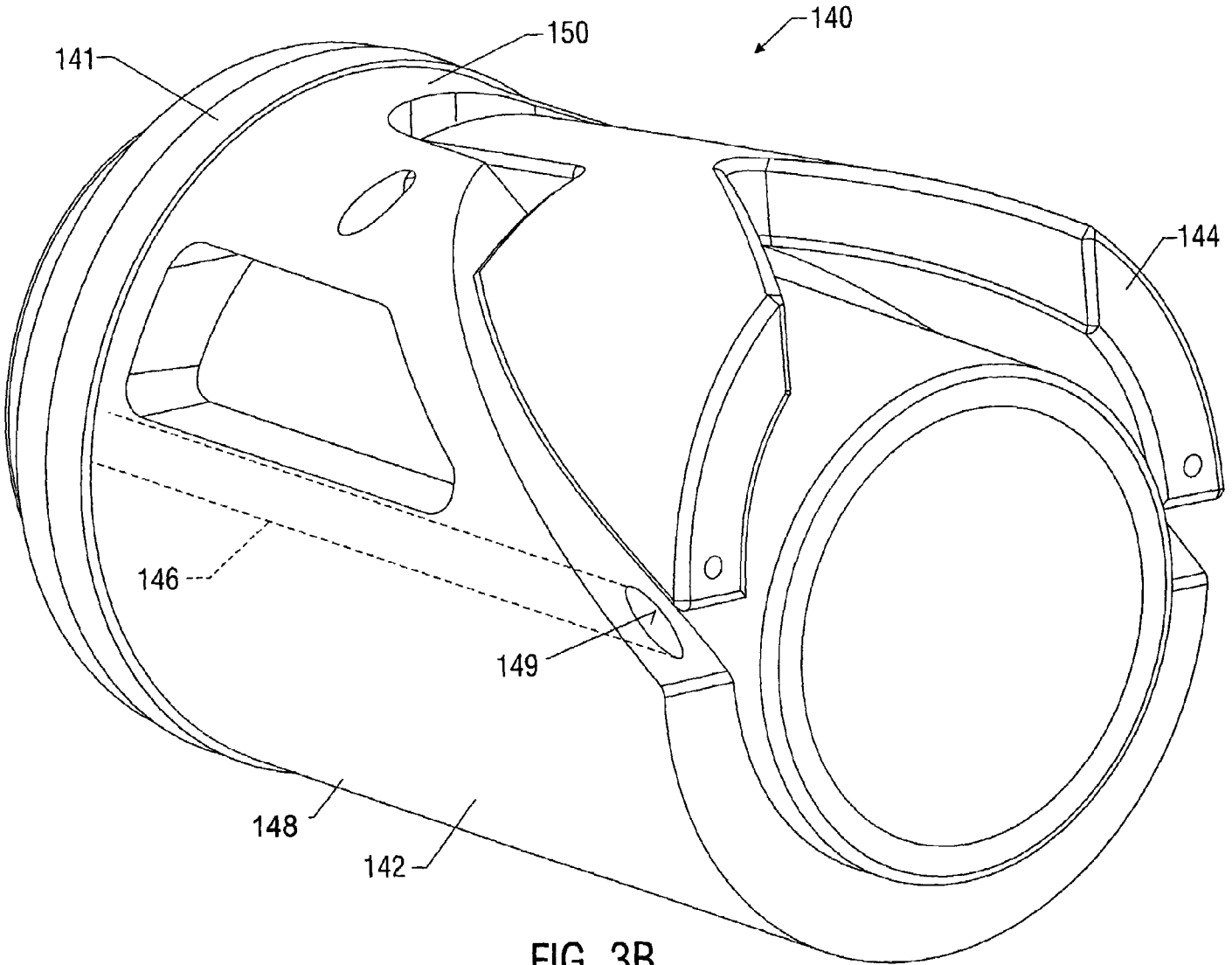
FIG. 3B is an isometric view of the FIG. 3A embodiment with the flow restriction member in the open position.

Referring now to FIG. 3B, the phase control device 140 is shown with the flow restriction element 144 in an open position. In the open position, the flow restriction element 144 separates from the body 142 to expose an inlet 149 of the passage 146. Thus, it should be appreciated that the flowing fluid has a first cross-sectional flow area when the flow restriction element is in an open position (FIG. 3A) and a second relatively smaller cross-sectional flow area when the flow restriction device is in the closed position (FIG. 3B). These cross-sectional flow areas can be preset or predetermined. It should also be appreciated that only a small degree of motion or articulation is needed to shift between the open and closed positions.

In some embodiments, the phase control device 140 can be installed in the wellbore in a manner that ensures that the flow restriction element 144 is immediately in the high side position. In other embodiments, the phase control device 140 can be configured to automatically align or orient itself such that the flow restriction element 144 moves into the high side position regardless of the initial position of the phase control device 140. For example, the body 142, which is adapted to freely rotate or spin around the pipe 145, can be configured to have a bottom portion 148 that is heavier than a top portion 150, the top portion 150 and bottom portion 148 forming a gravity activated orienting member or gravity ring. The flow restriction element 144 is coupled to the top portion 150. Thus, upon installation in the wellbore, the bottom portion 148 will rotate into a low side position 151 (FIG. 2) in the wellbore, which of course will position the flow restriction element 144 on the high side 149 (FIG. 2) of the wellbore. The weight differential between the top portion and the bottom portion 148 can be caused by adding weights to the bottom portion 148 or removing weight from the top portion 150. In other embodiments, human intervention can be utilized to appropriately position the phase control device 140 or a downhole motor, e.g., hydraulic or electric, can be used to position the phase control device 140 in a desired alignment.

In embodiments where the phase control device 140 rotates relative to the production tubular 145, the seals between the phase control device 140 and adjacent structures can be configured to selectively engage and seal against their respective structures. In one embodiment, the seal 141 between the phase control device 140 and the enclosing structure (not shown) and the seal (not shown) between the phase control device 140 and the production tubular 145 can have an initial reduced diameter condition that leaves a gap between the seals and their adjacent structures (e.g., housing or tubular). For example, these seals can be formed of a material that expands when exposed to a hydrocarbon such as oil. Thus, when running in the hole, the gap will prevent any seal friction from interfering with the operation of the gravity ring in properly orienting the body 142 on the tubular 145. Upon the seals being exposed to the hydrocarbons, the seals expand and become compressed between the body 142 and the housing (not shown) and production tubular 145, thereby forming seals therebetween and permitting fluid flow only through the phase control device 140. In other embodiments, pressurized fluid or mechanical devices (e.g., a sliding cylinder) can be used to expand the seals into engagement. It should be understood that in some embodiments the seal in an initial condition could contact an adjacent structure so long as the frictional forces created do not materially affect the rotation of the body 142.

It will be appreciated that a phase control device 140 utilizing a density sensitive flow restriction member is amenable to numerous variations. For example, the flow restriction element 144 can be positioned on the "low side" 151 (FIG. 2) of the production string. In this arrangement, the density of the material forming the flow restriction element can be selected to be less than the density of a first selected liquid such as water but greater than the density of a second selected liquid such as oil. Accordingly, the flow restriction element 144 "sinks" to an open position when in oil and "floats" to a closed position when in water. It should be appreciated that such embodiments passively control the fluid in-flow as a function of the type of the fluid (e.g., water or oil) rather than the phase of the fluid. Thus, embodiments of the present invention include flow control devices that utilize one or more density-sensitive members that control in-flow such that only one or more selected liquids flow into the production tubing.

Figure 3C:
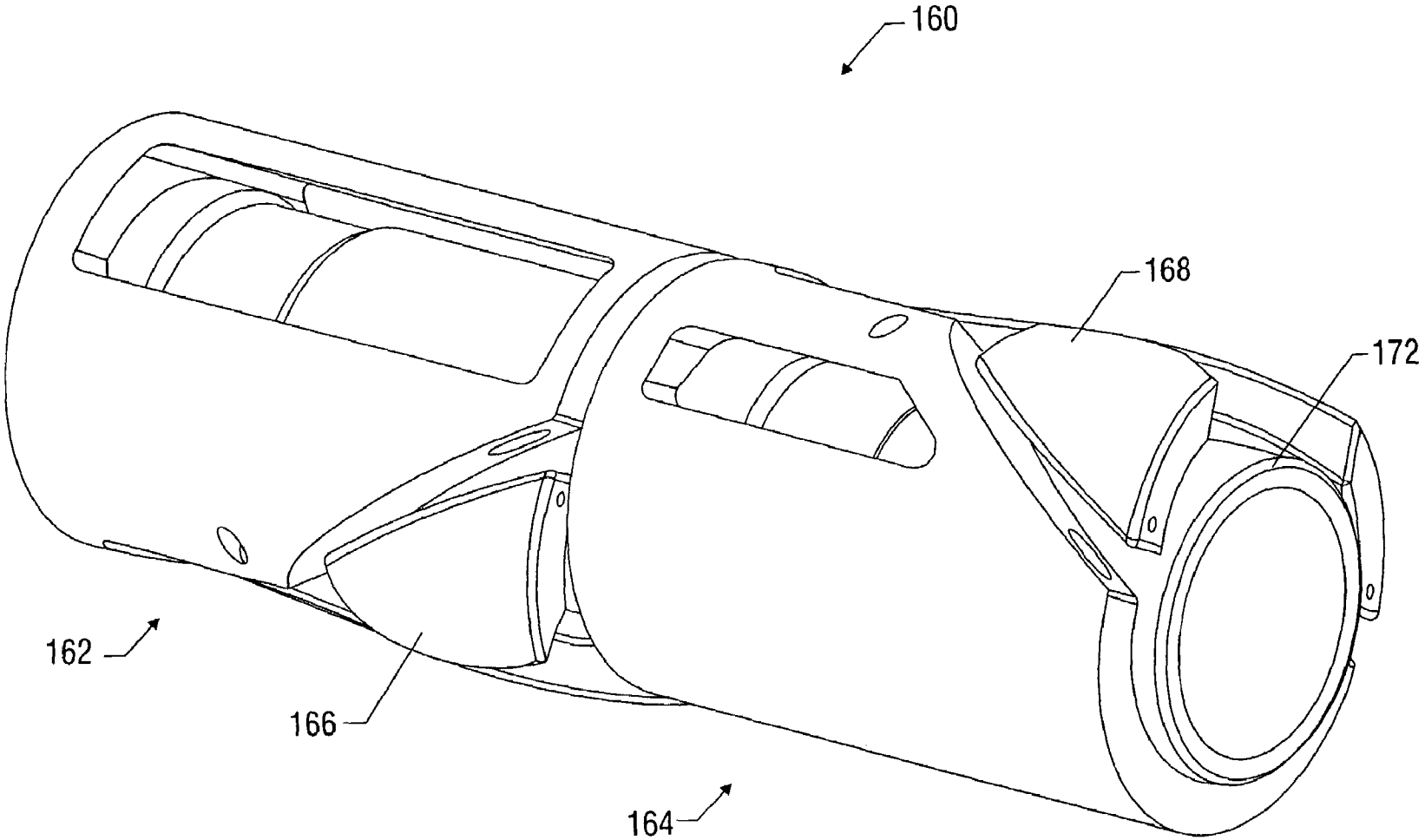
FIG. 3C is an isometric view of an embodiment of a flow control unit has multiple flow restriction capability.

In still other embodiments, two or more flow devices can be used to cooperatively control flow into the production string. For example, referring now to FIG. 3C, there is shown a flow control unit 160 having a serial arrangement wherein a first flow device 162 for restricting water flow and a second flow device 164 for restricting gas flow. The first flow device 162 has an appropriately selected flow restriction device 166 that restricts the flow of water but allows the flow of fluids lighter than water (e.g., oil and gas). The second flow device 164, which is positioned downstream of the first flow device 162, has a flow restriction device 168 selected to restrict the flow of gas but allows the flow of heavier fluids such as oil. One or more expandable seals (not shown) can be used to seal off the annular passages between the flow control unit 160 and production tubular 172 and between the flow control unit 160 and an enclosure (not shown). In yet other arrangements, the flow devices can be used in parallel. It should be understood that these embodiments are merely representative and not exhaustive of embodiments of flow devices within the scope of the present invention.

Figure 4:
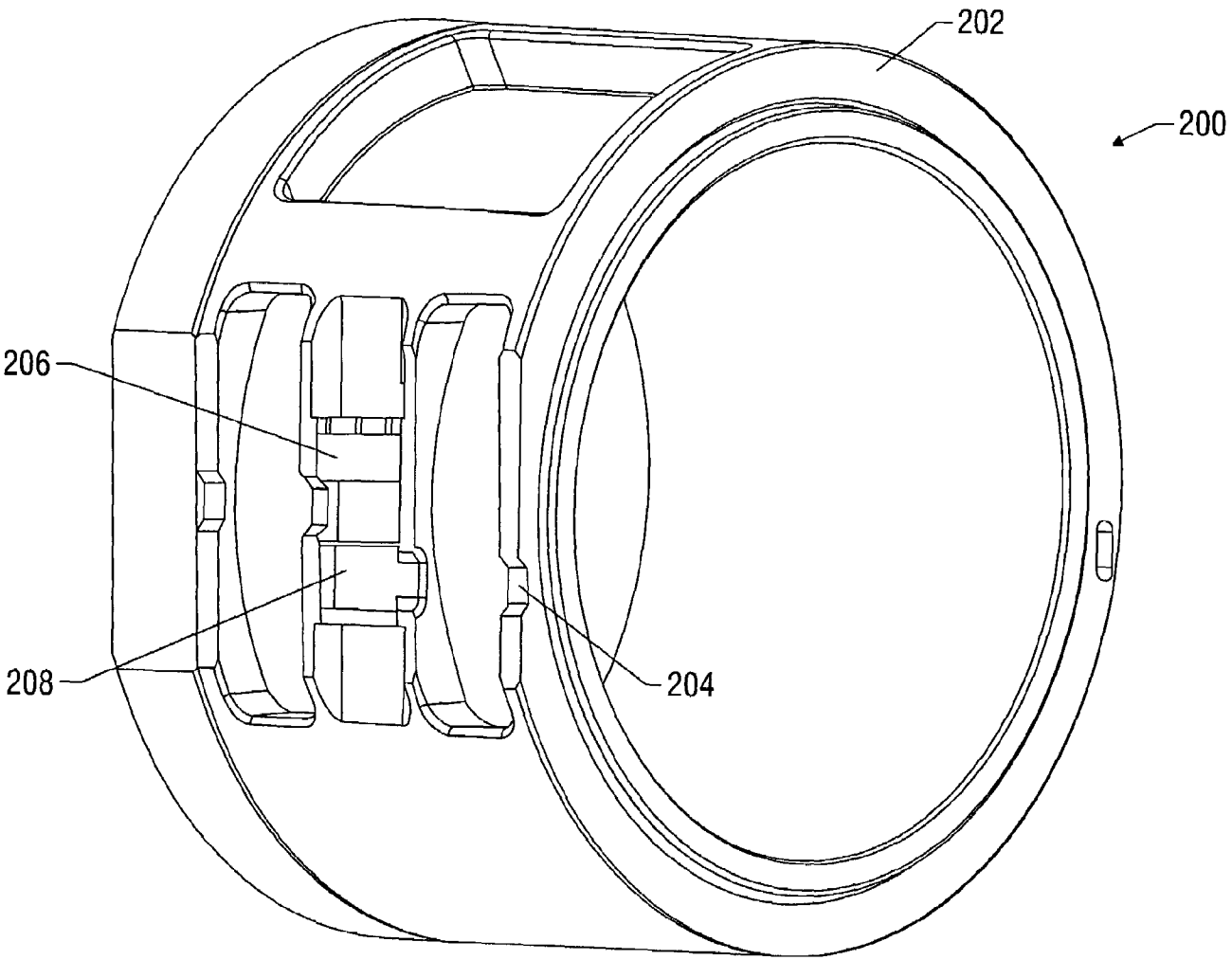
FIG. 4 is an isometric view of another phase control device made in accordance with one embodiment of the present invention.
Figure 5:
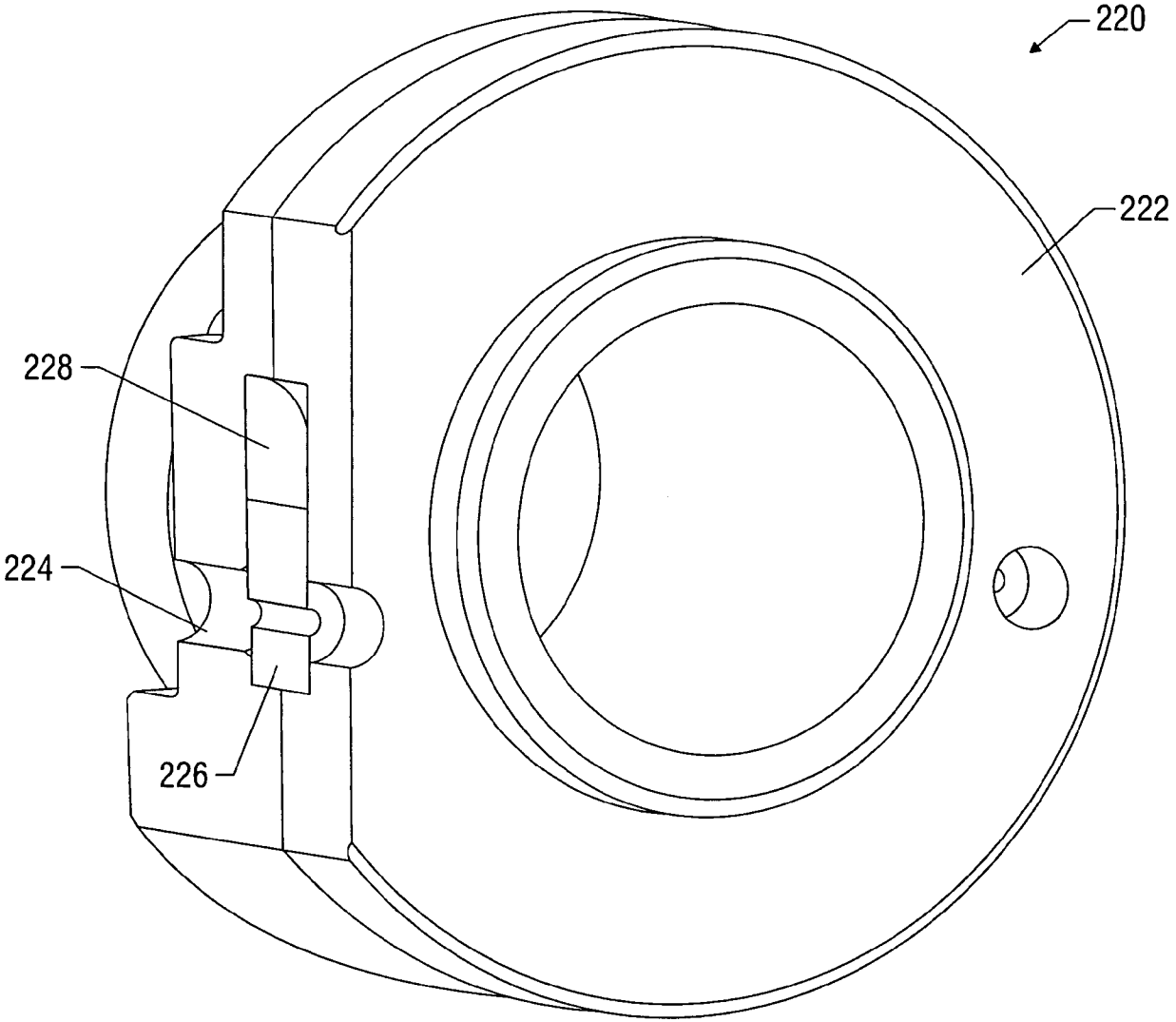
FIG. 5 is an isometric view of another phase control device made in accordance with one embodiment of the present invention.

Referring now to FIGS. 4 and 5, there are shown other embodiments of phase control devices. In FIG. 4, a flow control device 200 includes a body 202 having a flow passage 204 that provides fluid communication with the bore of a production string (not shown). A flow restriction member 206 translates or slides in a cavity 208 that intersects the flow passage 204. In FIG. 5, a flow control device 220 includes a body 222 having a flow passage 224 that provides fluid communication with the bore of a production string (not shown). A flow restriction member 226 translates or slides in a cavity 228 that intersects the flow passage 224. In the FIG. 4 and 5 embodiments, the flow restriction elements 204 and 224 are formed of a material having a density that permits the flow restriction element 204 and 224 to "float" to an open position when the flowing fluid is a liquid and "sink" to a closed position when the flowing fluid is a gas. In the open position, the flow restriction members 206 and 226 permits fluid to traverse the cavities 208 and 228, respectively, to thereby establish fluid communication to the production tubing. In the closed position, the flow restriction members 206 and 226 restrict fluid flow across the cavities 208 and 228, respectively.

As previously discussed in connection with FIG. 3, the sensitivity of the flow restriction elements to the density of the flowing fluid allows the flow restriction elements to passively control the fluid in-flow as a function of the phase of the fluid and/or the type of the fluid. Moreover, features such as weighted body portions can be used to orient the flow restriction elements in the appropriate azimuthal direction (e.g., high side, low side, etc.) in the wellbore. The FIG. 4 and 5 also illustrate how the teachings of the present invention are susceptible to numerous variations. For example, the passages 204 and 224 can be intersected by multiple cavities and associated flow restriction members. Each flow restriction member can be formed to have a different density. For example, one flow restriction member can be configured to float in water to block flow and an adjacent flow restriction member can be configured to sink in gas to block flow. Thus, in successive fashion, water flow is restricted and then gas flow is restricted.

Figure 6:
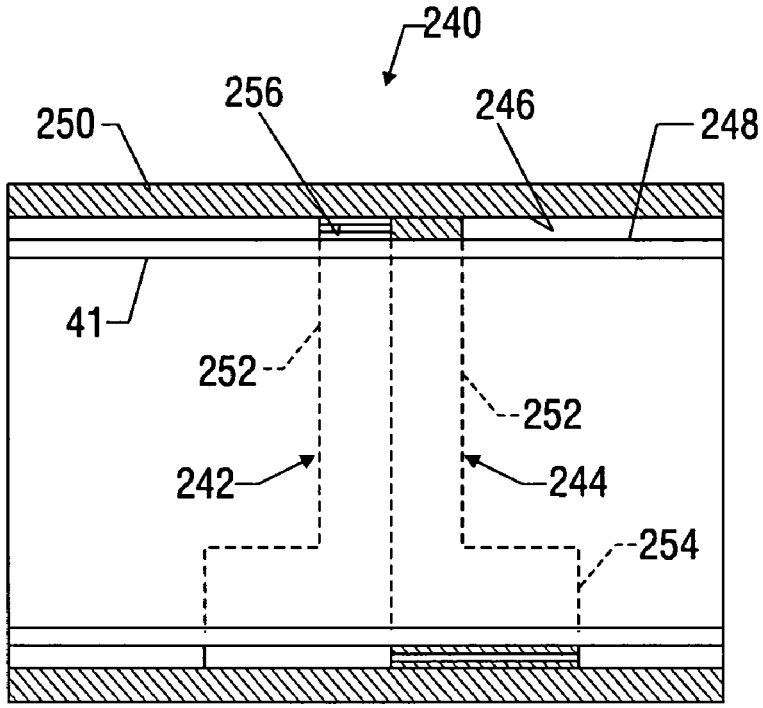
FIG. 6 shows an exemplary phase control device that is actuated in response to changes in fluid density with the valve in a closed position.
Figure 7:
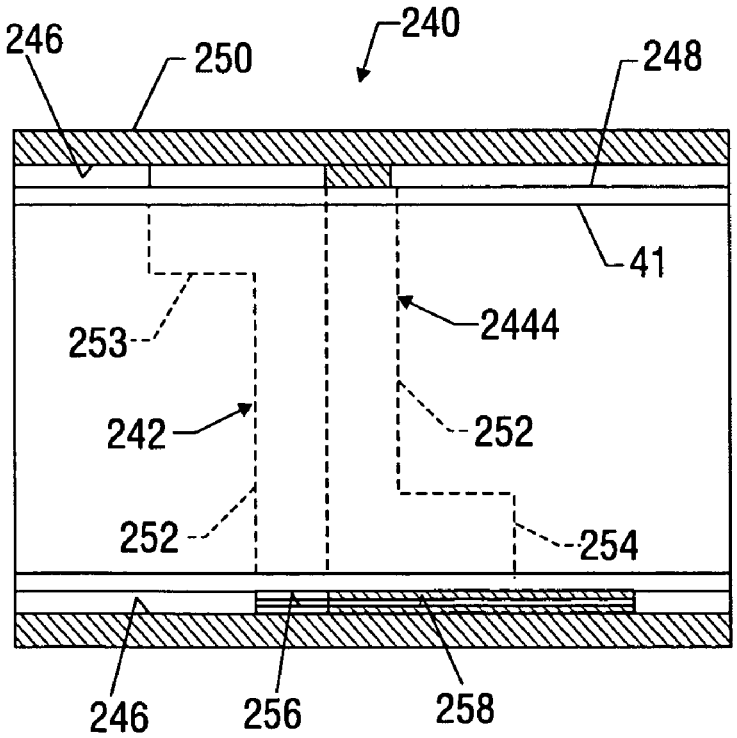
FIG. 7 shows the exemplary phase control device of FIG. 6 with the valve in an open position.

FIGS. 6 and 7 illustrate other embodiments of phase control devices in accordance with the present invention that are responsive to changes in production fluid density. An exemplary flow control device is described as a density-sensitive valve assembly 240 incorporated into a section of an inflow control device 38 (FIG. 1) and/or a suitable production control device 100 (FIG. 2) between the particulate control device 110 and fluid apertures 132. The valve assembly 240 is made up of a pair of valve members 242, 244 which reside within the flowspace 246 defined between the inner housing 248 and the outer sleeve 250 and are free to rotate within the flowspace 246. The valve members 242, 244 may be made of bakelite, Teflon® hollowed steel or similar materials that are fashioned to provide the operable density parameters that are discussed below. Each of the valve members 242, 244 includes an annular ring portion 252. The first valve member 242 also includes an axially extending float portion 253. The second valve member 244 includes an axially extending weighted portion 254. The weighted portion 254 is preferably fashioned of a material with a density slightly higher than that of water or of oil. The presence of the weighted portion 254 ensures that the second valve member 244 will rotate within the flowspace 246 so that the weighted portion 254 is in the lower portion of the flowspace 246 or wellbore low side when in a substantially horizontal run of wellbore. The float portion 253 of the first valve member 242 is density sensitive so that it will respond to the density of fluid in the flowspace 246 such that, in the presence lighter density gas, the valve member 242 will rotate within the flowspace 246 until the float portion 253 lies in the upper portion of the flowspace 246 or the wellbore high side(see FIG. 7). However, in the presence of higher density oil, the valve member 242 rotates so that the float portion 253 lies in the lower portion of the flowspace 246 (see FIG. 6).

In the first valve member 242, the ring portion 252 opposite the float portion 253 contains a first fluid passageway 256 that passes axially through the ring portion 252. In the second valve member 244, a second fluid passageway 258 passes axially through the ring portion 252 and the weighted portion 254. It can be appreciated with reference to FIGS. 6 and 7 that fluid flow along the flowspace 246 is only permissible when the first and second passageways 256, 258 are aligned with each other. This will only occur when there is sufficient fluid density to keep the first valve member 242 in the position shown in FIG. 7.

It should be appreciated that the above described embodiments of flow devices utilize density-sensitive elements to control flow into a production tubular. The movement and placement of these density-sensitive elements are predetermined or preset such that during operation a specified cross-sectional flow area is provided for a given condition. This condition can relate to a specified fluid state (e.g., liquid or gas) and/or a type or nature of liquid (e.g., water or oil). The value of the flow cross-sectional areas can range from zero to any specified value. Furthermore, the density-sensitive elements move in a predefined or predetermined motion such as linear motion or rotational motion between an open and closed position. This motion can be generally consistent and repetitive since the density sensitive element is articulated in a specified manner such as by a hinge or channel.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. An apparatus for controlling flow of formation fluid into a production tubular in a wellbore, comprising:

a flow restriction member controlling fluid flow into the production tubular, the flow restriction member being actuated by a phase change of the formation fluid and aligning itself with a predetermined orientation upon being positioned in the wellbore.

2. The apparatus according to claim 1 wherein the flow restriction member is actuated by a change in density of the formation fluid flowing into the production tubular.

3. The apparatus according to claim 1 wherein the flow restriction member is formed of a material having a density that is lower than a density of a selected liquid and higher than a density of a selected gas.

4. The apparatus according to claim 1 wherein the flow restriction member forms a first cross-sectional flow area for liquid and a second cross-sectional flow area for gas, the first cross-sectional flow area being larger than the second cross-sectional flow area.

5. The apparatus according to claim 4 wherein the flow restriction member is passive.

6. The apparatus according to claim 1 further comprising a body having a passage in communication with a bore of the production tubular, the flow restriction member being movably coupled to the body and selectively restricting fluid flow into the passage.

7. The apparatus according to claim 1 further comprising at least one seal associated with a body, the flow restriction device being coupled to the body, the seal being selectively engagable with an adjacent structure.

8. The apparatus according to claim 1 further comprising a body coupled to the production tubular, the body including a passage in fluid communication with a bore of the production tubular and wherein the flow restriction member includes a flapper hinged to the body.

9. The apparatus according to claim 1 wherein the phase change of the formation fluid flowing into the production tubular includes one of: (i) a transition in a density of the formation fluid, (ii) the formation fluid transitioning between a liquid and a gas, and (iii) the formation fluid transitioning between a water and an oil.

10. An apparatus for controlling flow of formation fluid into a production tubular in a wellbore, comprising:

(a) a flow restriction member controlling fluid flow into the production tubular, the flow restriction member being actuated by a phase change of the formation fluid; and (b) a body having a passage in communication with a bore of the production tubular, the flow restriction member being coupled to the body and selectively restricting fluid flow into the passage, wherein the body is rotatably coupled to the production tubular and rotates to a predetermined orientation upon being positioned in the wellbore.

11. The apparatus according to claim 10 wherein the predetermined orientation is one of (i) wellbore highside, and (ii) wellbore lowside.

12. The apparatus according to claim 10 wherein the phase change of the formation fluid flowing into the production tubular includes one of: (i) a transition in a density of the formation fluid, (ii) the formation fluid transitioning between a liquid and a gas, and (iii) the formation fluid transitioning between a water and an oil.

13. A method for producing fluid from a subterranean formation, comprising:

(a) positioning a flow restriction device in a wellbore, the flow restriction device aligning itself with a predetermined orientation upon being positioned in the wellbore; and (a) passively controlling a flow of fluid into a production tubular in response to a phase change of the fluid with the flow restriction device.

14. The method according to claim 13 further comprising controlling a flow of fluid into a production tubular in response to a change in density of the fluid flowing into the production tubular.

15. The method according to claim 13 further comprising providing a first cross-sectional flow area for liquid and a second cross-sectional flow area for gas, the first cross-sectional flow area being larger than the second cross-sectional flow area.

16. The method according to claim 13 wherein the fluid flow into the production tubular is controlled in a plurality of spaced apart locations along the production tubular.

17. The method according to claim 16 further comprising controlling the fluid flow in the plurality of spaced apart locations such that the fluid in the production tubular is substantially a liquid.

18. The method according to claim 17 wherein the liquid is substantially an oil.

19. The method according to claim 13 further comprising coupling a body to the production tubular, the body including a passage in fluid communication with a bore of the production tubular and hinging the closure member to the body.

20. The method according to claim 13 wherein the phase change of the fluid flowing into the production tubular includes one of: (i) a transition in a density of the formation fluid, (ii) the formation fluid transitioning between a liquid and a gas, and (iii) the formation fluid transitioning between a water and an oil.

21. An apparatus for controlling flow of formation fluid into a production tubular in a wellbore, comprising:

a body coupled to the production tubular, the body including a passage in fluid communication with a bore of the production tubular and aligning itself with a predetermined orientation upon being positioned in the wellbore; and a closure member movably coupled to the body and selectively blocking the passage, the closure member being actuated by a change in density of the formation fluid flowing into the production tubular.

22. The apparatus according to claim 21 the closure member has an open position and a closed position, the closure member being adapted to reduce a cross-sectional flow area for the formation fluid when in a closed position.

23. The apparatus according to claim 21 wherein the closure member is formed of a material having a density that is lower than a density of a selected liquid and higher than a density of a selected gas.

24. The apparatus according to claim 21 wherein the closure member is formed of a material having a density that is lower than a density of water and higher than a density of an oil.

25. The apparatus according to claim 21 wherein the actuation is selected from one of (i) translational movement, and (ii) rotational movement.

26. The apparatus according to claim 21 further comprising:

(i) a particulate control device reducing the size of entrained particles in the fluid before the fluid enters the passage of the body; and (ii) an inflow control device reducing the flow rate of the fluid entering the passage.

27. The apparatus according to claim 21 further comprising at least one selectively expandable seal, the seal expanding into engagement with an adjacent structure upon being exposed to a hydrocarbon.

28. The apparatus according to claim 21 wherein the closure member is hinged to the body.

* * * * *